US006397858B1

(12) United States Patent
Cubillo-Buron

(10) Patent No.: US 6,397,858 B1
(45) Date of Patent: Jun. 4, 2002

(54) DENTAL CONCAVE AND CONVEX RAKE

(76) Inventor: Daniel Cubillo-Buron, Edificio Otawa 104, Insurgentes sur No. 4031, Colonia Santa Ursual Xitla (MX)

( * ) Notice: Subject to any disclaimer, the term of this patent is extended or adjusted under 35 U.S.C. 154(b) by 0 days.

(21) Appl. No.: 09/341,653

(22) PCT Filed: Jul. 4, 1997

(86) PCT No.: PCT/MX97/00015

§ 371 Date: Sep. 15, 1999

(87) PCT Pub. No.: WO98/31294

PCT Pub. Date: Jul. 23, 1998

(30) Foreign Application Priority Data

Jan. 15, 1997 (MX) ..... 970399

(51) Int. Cl.[7] ..... A45D 44/18; A45D 11/00; A46B 9/04

(52) U.S. Cl. ..... 132/308; 132/311; 15/167.1

(58) Field of Search ..... 132/308, 309, 132/311, 313, 317, 216; 15/105, 106, 167.1, 176.1, 176.2, 111, 110

(56) References Cited

U.S. PATENT DOCUMENTS 1,186,330 A * 6/1916 Peck ..... 15/167.1
2,834,975 A * 5/1958 Perwas ..... 132/308
3,937,235 A * 2/1976 Broughton ..... 132/308
4,030,845 A * 6/1977 Deckert ..... 401/268
4,109,338 A * 8/1978 Mertes ..... 15/105
4,399,582 A * 8/1983 Ernest et al. ..... 15/176
4,543,679 A * 10/1985 Rosofsky et al. ..... 15/110
4,638,521 A * 1/1987 Potente et al. ..... 15/111
4,679,272 A * 7/1987 Florence ..... 15/106
5,061,272 A * 10/1991 Reese ..... 606/161
5,127,415 A * 7/1992 Preciutti ..... 132/323
5,267,528 A * 12/1993 Murieen ..... 119/88
5,348,028 A * 9/1994 Gustavel ..... 132/309
5,438,726 A * 8/1995 Leite ..... 15/105
5,570,487 A * 11/1996 Schneider ..... 15/167.1
D378,411 S * 3/1997 Taoatao ..... D24/146
5,613,262 A * 3/1997 Choy-Maldonado ..... 15/160
5,628,082 A * 5/1997 Moskovich ..... 15/110
D383,540 S * 9/1997 Woo ..... D24/147

FOREIGN PATENT DOCUMENTS

IT 506632 12/1954
NL 8303829 6/1985

* cited by examiner

*Primary Examiner*—John J. Wilson
*Assistant Examiner*—Robyn Kieu Doan
(74) *Attorney, Agent, or Firm*—Synnestvedt & Lechner LLP

(57) ABSTRACT

The present invention is related to a dental concave and convex rake whose combination of parts allows to replace the horizontal motion of the traditional dental brushes by an anatomical vertical motion, thus achieving a complete and effective cleaning of the inner and outer faces of the teeth and molars in human beings, as well as a massage of the gums, tongue, palate and inner face of the checks. The dental rake consists of a handle to hold the rake, which includes at least on one of its ends, a female connection, where a rake head is inserted and, at least a concave and/or convex rake head interconnected to a stem which, on its lower end, includes a male connection, which is inserted under pressure in the female connection of said handle.

4 Claims, 4 Drawing Sheets

DENTAL CONCAVE AND CONVEX RAKE

FIELD OF INVENTION

This invention refers to the technique for proper brushing and cleaning of the teeth and more particularly it is related to a dental concave and convex rake.

BACKGROUND OF INVENTION

For at least 25 years, dental associations and dentists, in particular, have been practically requiring proper brushing of the teeth.

A large variety of toothbrushes are known with regard to size, curvature and design of the handles, number of rows of bristles, cut of the bundles of bristles, different degrees of hardness of the bristles; depending on whether they are natural or made of synthetic materials, but all of them coincide in that the head of the brush and the handle are collinear, forcing the user to make a horizontal motion that is generally fast when brushing the teeth, which is disadvantageous, since to dislodge the waste of food from the interstices of teeth and molars, one must make a vertical motion forcing the wrist, therefore, most people are not accustomed to doing so; in addition, the brushes that are already known, when moving horizontally quickly and violently cause the gums to retract, and moving that way is opposite to the direction of the enamel of the teeth.

It is frequent that dentists attribute many of the cavity and gum problems that occur presently to deficient brushing. These comments are attributed to an assumed (or actual) bad rearing that we provide on our children with regard to dental and oral hygiene.

Listed below are some of the recommendations that dentists give in trying to avoid the problems already mentioned:

1) Vertical motion while brushing. Dentists recommend that the own anatomical design of the tooth should be followed, as well as the direction of growth of enamel.

2) Rotary motion while brushing. Also, dentists recommend to press on the brush small powerful turning movements so that the bristles will expel food residues from the interstices of the teeth and molars.

3) Avoid retraction of the gums. The rotary motion mentioned in the previous point offers another benefit, which consists of preventing the retraction of the gums, which uncovers the ivory of the root, which causes actual rows of cavities all along the set of teeth. In addition, this rotary motion, while brushing, provides a massage on the gums and a decongestion of the same, strengthening them and favoring a good blood circulation, all of them helping to prevent certain infections, with one of them being pyorrhea.

4) Cleaning of the wisdom teeth. Dentists insist that the last teeth (wisdom teeth) be cleaned as much as possible, both upper and lower ones, trying to rub the hidden parts of the same, which are practically inaccessible.

5) Cleaning of the inner faces of the set of teeth. Dentists warn that if the inner faces of the set of teeth are not cleaned appropriately and regularly, at some point in time you will have to perform a cleaning by the cavitron insert in order to remove the tar as well as the bacterial plaque, that are another reason for deterioration of the teeth (detartragia).

It is important to mention that the traditional brush does not allow to meet all these recommendations, since with respect to what is mentioned in Point Number (1) in relation to the vertical motion of the brushing, the traditional brush induces to a natural horizontal motion due the own characteristics of the design, which forces us to achieve a vertical motion forcing the shoulder, elbow and wrist, causing with this that these forced motions and the motion induced by the design of the traditional brush come into conflict. If this becomes difficult for adults, one must take into account that for children, it becomes a "torture" with regard to the habits of dental hygiene.

With respect to what is mentioned in Point Number (2) in relation to the rotary motion while brushing if the traditional design induces to the horizontal motion and the vertical motion is forced, we agree that it is totally contradictory to a rotational movement; therefore, the rotary motion of the brush is achieved by forcing the wrist, causing with it that once more have the design of the brush to conflict with the movements recommended by dentists.

With regard to what is indicated in Point Number (3) in relation to avoiding the retraction of the gums while brushing with the traditional brush, what is mentioned in the previous paragraph explains why we cannot achieve a satisfactory massage of the gums.

On the other hand, with regard to what is mentioned in Point Number (4) in relation to the cleaning of the wisdom teeth with the traditional brush, the design of the same makes it difficult to reach the faces of said wisdom teeth, above all the external faces and to be able to do the proper run to clean the sides of the bottom of the cheeks.

Finally, with regard to what is indicated in Point Number (5) in relation to the cleaning of the internal faces of the set of the teeth with the traditional brush, the design of this makes it possible to achieve the cleaning of certain zones of the inner face of the set of teeth; however, the zone that runs the most danger from the plaque and tar viewpoint is the inner face of the lower front teeth, which cannot be cleaned properly with the traditional toothbrush.

As a result of the above, we have tried to solve the aforementioned problems in a simple, practical and economical way looking for the brushing and cleaning operation to be done efficiently.

OBJECTS OF THE INVENTION

Taking into account the defects of the above technique, an object of the present invention is to provide a dental concave and convex rake that allows to perform the dental cleaning operation more efficiently.

It is another object of the present invention to provide a dental concave and convex rake, that allows the cleaning of the teeth and molars to be done covering all their faces simply, practically and functionally.

The aforementioned objects, as well as other objects and advantages of the invention, are achieved by the use of a dental concave and convex rake that consists of a handle for grabbing the rake, which includes, on one of its ends, at least a female connection where a rake head is inserted, and, at least a concave and/or convex rake head interconnected to a stem, which, on its lower end, includes a male connection, which is inserted under pressure in the female connection of said handle; said rake head includes a concave or convex plate where many bristles are attached.

BRIEF DESCRIPTION OF THE DRAWINGS

The innovative aspects that are considered characteristic of this invention will be established particularly in the attached claims. However, the invention itself, both due to its organization and due to its method of operation, jointly with other objects and advantages of the same, will be understood better in the following description of certain embodiments, when it is read in relation to the drawings that are enclosed, in which:

DETAILED DESCRIPTION

As was previously mentioned, the object of the present invention is to eliminate the problems of traditional brushes by using the dental concave and convex rake that is described hereinafter, which, due to having concave and/or convex heads, that can be interchangeable or not, by a mere pressure mechanism, and since these are placed perpendicularly in relation to the handle, allow cleaning of the teeth and molars to be performed on all their faces, adapting to the majority of the curves of the sets of teeth of adults or infants, since the concave head of the rake allows to dislodge the residues of food from the interstices of the teeth and molars with similar efficiency to that of dental floss, reaching down to the wisdom teeth and going around them, while the convex head of the rake fight off tar and bacterial plaque from the inner face of the teeth and molars. The above is achieve thanks also to the fact that the curvature of the concave and convex heads follow the anatomical shape of the set of teeth and to the fact that the dental concave and convex rake in this invention eliminates the horizontal motion of the traditional teeth by a rake type vertical motion which is achieved due to the design of the same, since the handle and the head of the rake where the cleaning bristles are located are perpendicular to each other and not collinear as in the brushes of the present-day technique.

The concave and convex design of the heads of the dental rake allows the motion during dental cleaning to follow the anatomical shape of the set of teeth and the direction of the enamel, which grows in a longitudinal vertical shape, resulting in an effect totally opposed to that of the traditional brush that rubs the enamel crosswise.

In addition, the slow vertical motion of the dental concave and convex rake helps prevent the retraction of the gums and therefore helps the set of teeth not to be peeled off, exposing areas without enamel to cavities or certain infections, such as pyorrhea.

Furthermore, the dental concave and convex rake modifies the anti-anatomic motion of the hand when using the traditional brush, by replacing it with an anatomical vertical motion forced by the actual design and shape of the dental rake, all of which makes it more comfortable, easy to use, effective, practical and long-lasting in its construction.

Figure 1:
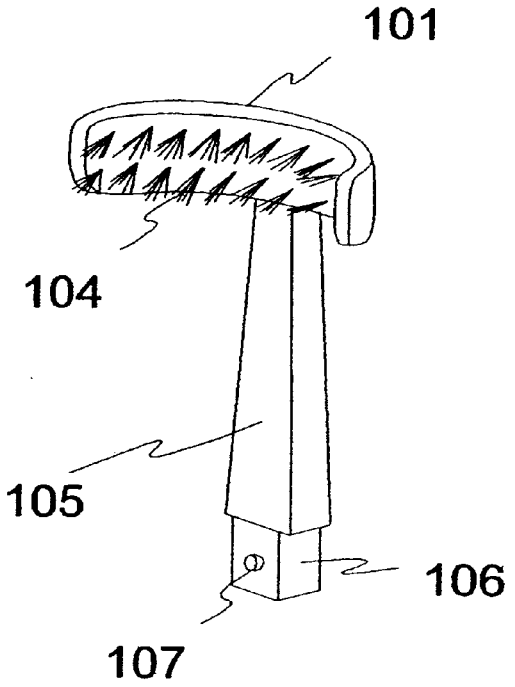
FIG. 1 shows a perspective view in upper elevation of the head of a dental concave rake, built in conformity with a preferred embodiment of the present invention.
Figure 2:
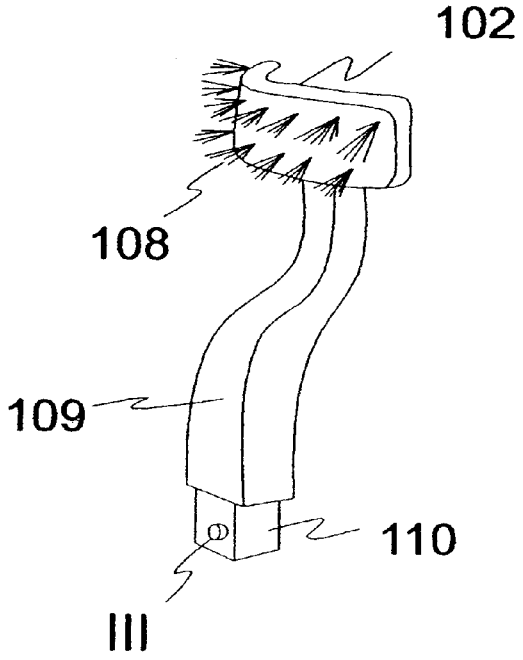
FIG. 2 shows a perspective view in upper elevation of the head of a dental convex rake, built in conformity with another preferred embodiment of the present invention.
Figure 3:
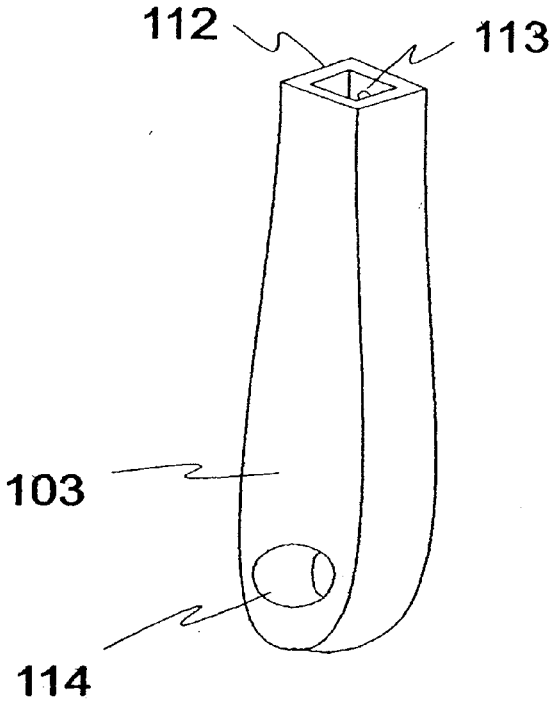
FIG. 3 shows a perspective view in upper elevation of the handle of the dental concave and convex rake, built in conformity with the principles of the present invention.

The characteristic details of this dental concave and convex rake are clearly shown in the following description and on the drawings that accompany it, as an illustration of the former and with the same reference signs serving to indicate the same parts in the shown figures:

FIGS. 1, 2 and 3 correspond to a preferred embodiment of this invention where concave head 101, convex head 102, and handle 103 of a dental concave and convex rake are shown respectively, as well as the pressure mechanism whereby heads 101 and 102 are incorporated in handle 103 of the dental rake, as can be viewed in said three figures.

In reference to said figures, the dental concave and convex rake comprises handle 103 to grab said dental rake, which includes at least on one of its ends a female connection 112, where a rake head is inserted and, at least one concave rake head 101 and/or convex rake head 102, which include one stem 109, respectively on their lower portions, centrally located and perpendicular to said heads 101 and 102.

Stem 105 and stem 109 include, and their lower end, male connections 106 and 110, respectively, which are for inserting under pressure in the female connection 112 of said handle 103.

In more detail, the rake head 101 comprises a concave plate that has the average curvature of the front portion of the set of teeth of a human being and on the front or concavity it has a plurality of bristle bundles 104 spread all throughout its surface, which are perpendicular to the front face of the concave head 101, following its curvature.

This concave rake head 101, as was already mentioned, includes on its lower portion, centrally located and perpendicular to said head 101 a stem 105, which in the embodiment that is described, has a straight path with a male connection 106 on its lower end, which comprises a reduction in size so as to form a rung, which includes, on its outer surface, at least two small salient projections 107 opposite to each other, preferably of a cylindrical shape to be coupled with female connection 112 of handle 103.

The convex rake head 102 consists of a convex plate that has the average curvature of the inner portion of the set of teeth of a human being and on the front or convexity it has a plurality of bristle bundles 108, spread all throughout its surface, which are perpendicular to the front face of convex head 102, following its curvature.

This convex rake head 102, as was already mentioned, includes, on its lower portion, centrally located and perpendicular to said head 102 a stem 109 which in the embodiment, that is described, has a curved path, with the necessary curvature to allow the cleaning of the desired row of teeth without striking or obstructing the opposite row of teeth and with a male connection 110 on its lower end, which consists of a reduction in size so as to form a rung which includes, on its outer surface, at least two small salient projections 111, opposite to each other, preferably in a cylindrical shape to be coupled with female connection 112 of handle 103.

Handle 103 is straight and has on its upper part a female connection 112 that comprises a hollow portion as an indentation, which includes, on its inner surface, at least two small hollow areas 113 opposite to each other, preferably in a cylindrical shape which is precisely where the salient projections 107 and 111 are inserted to adjust concave head 101 and convex head 102, respectively. Handle 103 also includes, on its lower end, an orifice 114, which is used to hang the dental rake 100.

It is important to mention that all the edges of the dental concave and convex rake are rounded to prevent any rubbing against them.

Concave head 101 and convex head 102 may contain one or more rows of bristles 104 and 108, respectively, as hard or smooth, as you like, as dense or sparse as you like, so as to achieve a rake effect (vertical motion perpendicular to the displacement axis) up to a brush effect (horizontal motion parallel to the displacement axis) with the idea of dislodging food residues, in addition to including the concept of massaging gums, tongue, palate and inner face of the cheeks.

The dental concave and convex rake can be made from plastic material or from any other appropriate material, as well as the plurality of bristles 104 and 108.

Figure 4:
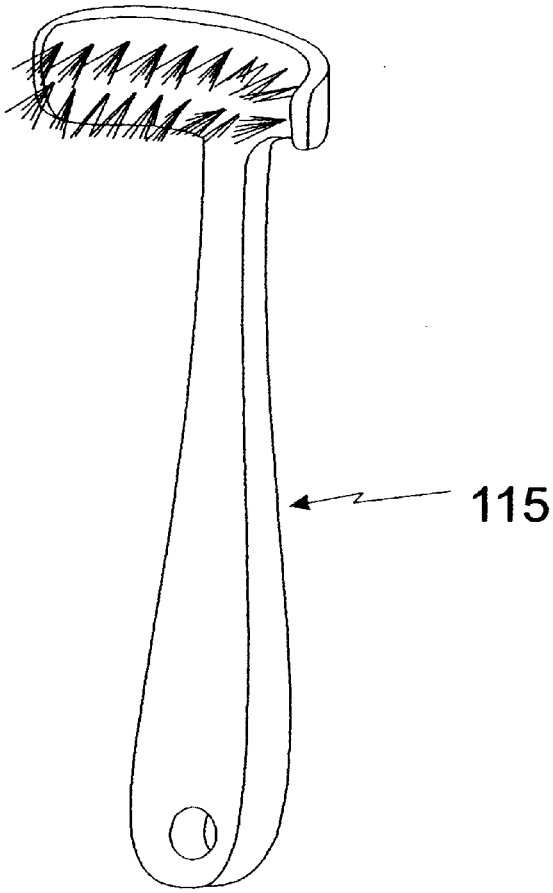
FIG. 4 shows a perspective view in upper elevation of an additional embodiment of the dental concave rake, built in conformity with the principles of the present invention.
Figure 5:
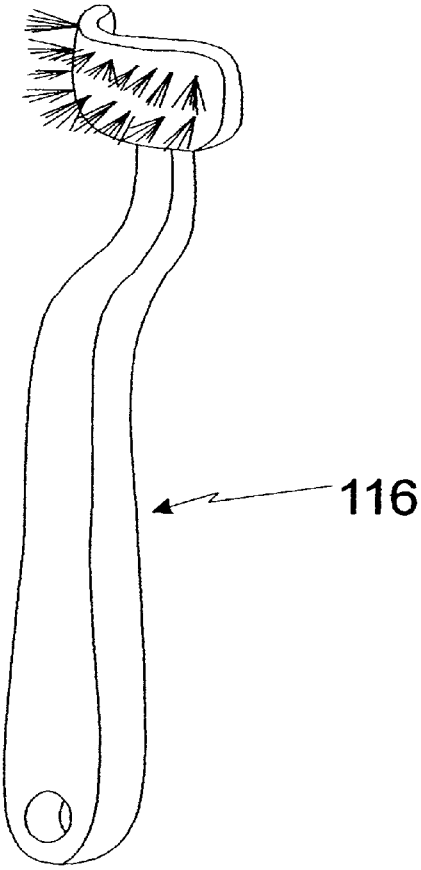
FIG. 5 shows a perspective view in upper elevation of an additional embodiment of the dental convex rake, built in conformity with the principles of the present invention.

FIGS. 4 and 5 show additional embodiments of the concave and convex rake of the present invention, identified with numbers 115 for the dental rake with a concave head and 116 for the dental rake with a convex head.

As it could be seen, in these embodiments, the rake handle and the concave and convex heads are made from one single piece, and their characteristics and properties are identical to that described previously in the case of the dental rake with interchangeable concave and convex heads on one single handle.

Figure 6:
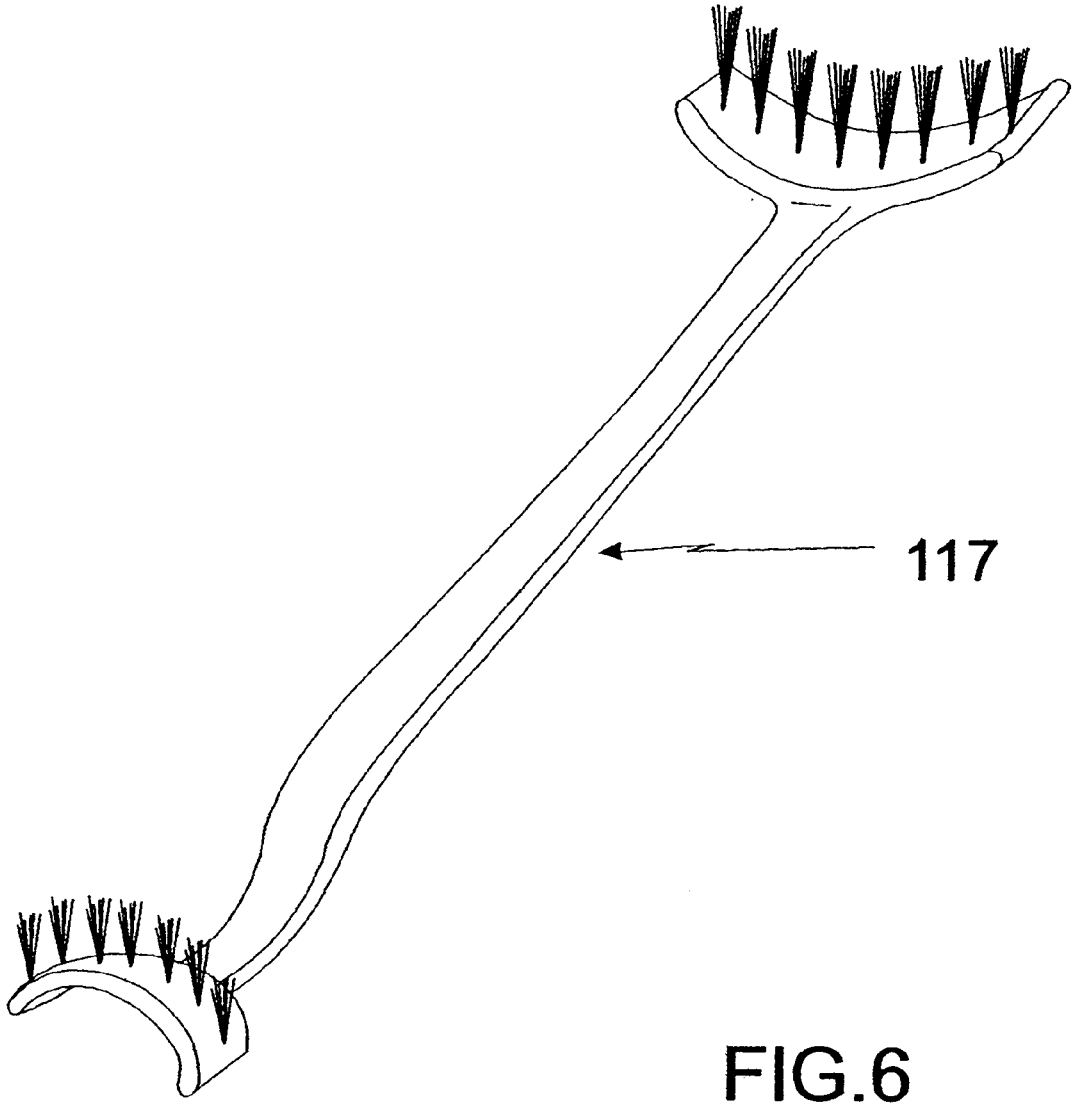
FIG. 6 shows a perspective view in upper elevation of a dental rake that includes on both its ends a concave head and a convex head, built in conformity with an additional embodiment of the present invention.

FIG. 6 shows another additional embodiment of the concave and convex rake of the present invention, identified with number 117, with said embodiment consisting basically of the fact that concave and convex heads are integrated to the ends of a single handle, one head for each end, forming one single piece. The characteristics and properties of the heads and the handle are identical to that previously described in the case of the dental rake with interchangeable concave and convex heads on one single handle.

Figures 7, 8, 9:
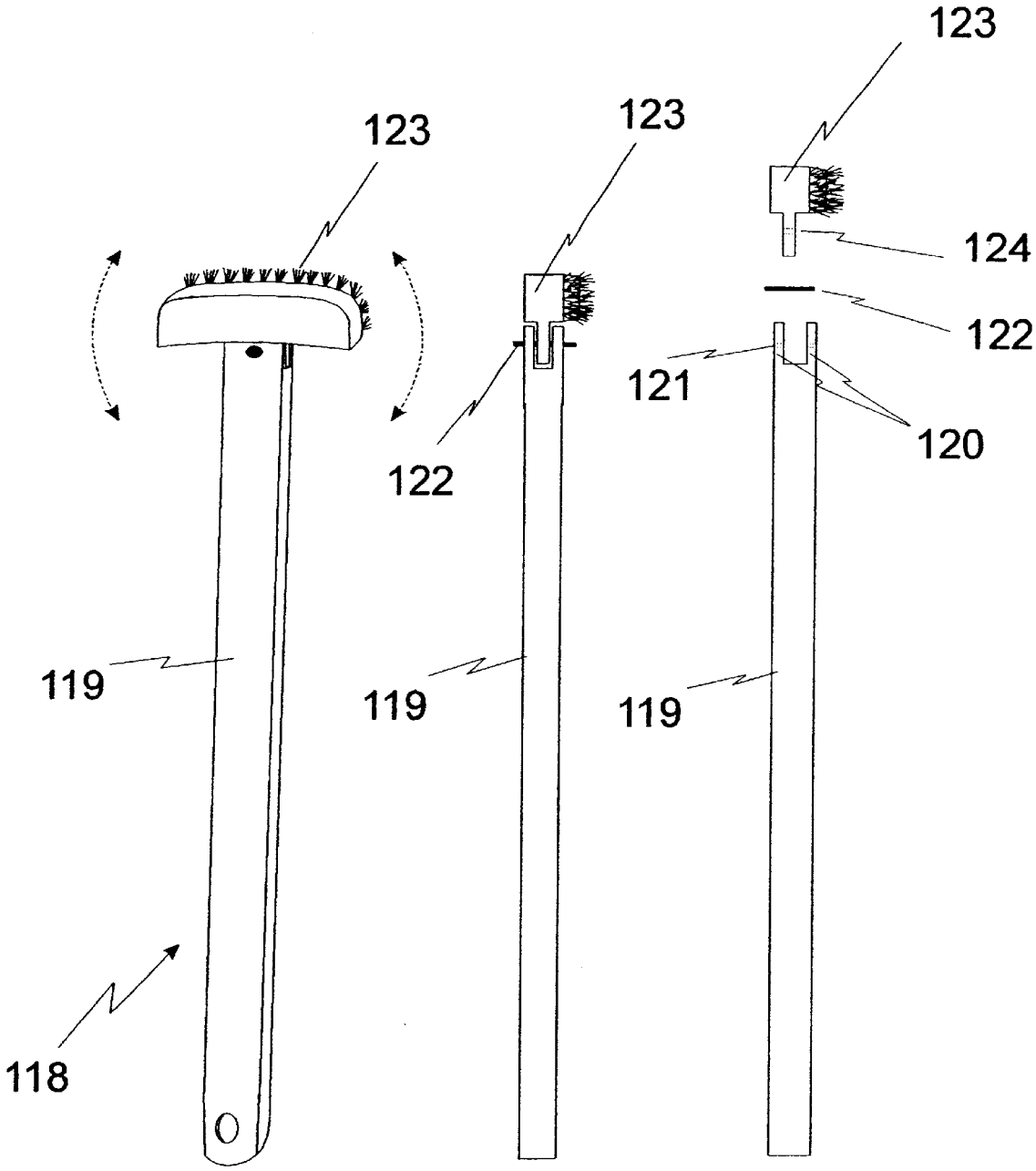
FIG. 7 shows a perspective view in upper elevation of a dental concave and convex rake with oscillatory head, built in conformity with an additional embodiment of the present invention.
FIG. 8 shows a lateral view of the dental rake with oscillatory head of FIG. 7.
FIG. 9 shows a lateral view of the dental rake of FIG. 7 disassembled.

FIGS. 7 to 8 show another additional embodiment of the concave and convex rake of the present invention, identified with number 118, with said embodiment consisting basically of the fact that the concave and convex heads are oscillatory and are incorporated to one of the ends of a single handle so that each head has its own handle.

For the head to be movable, handle 119 includes, on its upper end a pair of flat vertical projections 120 opposite to each other, so as to form a hollow space between them, with said vertical projections 120 also including a central perforation 121 that crosses them completely to allow the insertion of bolt 122.

Concave and/or convex head 123 includes on its lower end a perforated tongue 124 for the purpose of being able to introduce it in the hole formed between vertical flat projections 120 so that the perforation of tongue 124 coincides with perforation 121 of projections 120 to allow the insertion of bolt 122 and attachment of head 123 to handle 119.

Allowing the head of the rake to swing in this embodiment is what causes it to reach down to the last wisdom teeth more comfortably.

Characteristics and properties of heads 123 and handle 119 are identical to that described previously in the case of the dental rake with interchangeable concave and convex heads on a single handle.

It is important to mention that prototypes of the present invention have been implemented under many variants, and they have found that the most viable prototypes are the object of this patent application.

In practice, we have been able to establish an evaluation of the prototypes and observe that they do properly meet the requirements set forth by dentists and dental associations, trying to avoid the problems described in the chapter of background of the invention.

With respect to the vertical motion while brushing mentioned as point number (1) in the chapter of background, the dental rake of the present invention forces, by its own design, a natural vertical motion, therefore, the anatomy of the arm, of the teeth and the motion induced by the design of the rake, come into harmony.

With regard to the rotary motion while brushing mentioned as point number (2) in the chapter of background, the own design of the dental rake of the present invention, including that with one single row of bristles, achieves the desired goal, within its own vertical motion, without requiring at all any type of turning of the wrist, in addition to the fact that it is much easier to teach children how to brush their teeth when they have a proper tool.

Concerning the retraction of the gums mentioned as point number (3) in the chapter of background, if the movement of the horizontal brushing causes contraction and retraction of the gums, it turns out that the dental rake of the present invention, by its own design, does not allow "sudden" movements and thus leads to the desired result, which consists of attracting as much as possible the gums toward the tooth. Additionally, we have noted that in the first few brushings with the dental rake, without violence, minor bleeding is caused which decongests the gums.

With respect to the cleaning of the wisdom teeth mentioned as point number (4) in the chapter of background, with the dental rake of the present invention, we have been able to note that the "forced" vertical motion and the curvature, both of the concave head and the convex head, an easy access to the wisdom teeth is obtained, being able to go around them.

Finally, with regard to the cleaning of the inner faces of the set of teeth mentioned as point number (5) in the background chapter, in the dental rake of the present invention, the convex head has been designed to comfortably clean the inner faces of the teeth and the molars totally, deeply and pleasantly.

We should mention the benefits that can be obtained in the overall health of users if they constantly use the dental rake of the present invention since negative consequences of an unsuitable oral hygiene are eliminated.

As you will be able to see, the present invention is distinguished by the fact that it is a simple, practical and economical construction, in addition to its great simplicity and easy handling, thus allowing to meet the requirements of a suitable dental cleaning.

Even when certain specific embodiments of the present invention have been illustrated and described, it should be emphasized that numerous modifications to the same are possible. Therefore, the present invention must not be considered as restricted, except with regard to what is required by the previous technology and the spirit of the attached claims.

What is claimed is:

1. A dental rake comprising:

a detachable head having a lower section which includes a stem defining a male connection, said male connection having a pair of projections extending axially from said stem, said head having a concave or convex face having bristles; and a handle for receiving said head, said handle defining a female connection configured to receive and retain said male connection;

wherein said female connection comprises a pair of longitudinal projections opposite and spaced from one another, said projections including an aperture for receiving a hinge pin, said male connection comprising a tongue having an aperture configured to cooperate with said apertures of said longitudinal projections and thereby capable of receiving said hinge pin to attach said head to said handle.

2. The dental rake of claim 1, wherein said head is formed as a single piece having said concave or convex face.

3. A dental rake comprising:

a detachable head having a lower section which includes a stem, said head having a convex or concave curved bristle-bearing face extending perpendicular to said stem, said stem defining a male connection having a cross-sectional width less than a cross-sectional width of said stem adjacent said male connection, said male connection comprising a pair of projections, each of said projections having a proximal and a distal end and a longitudinal axis extending through said proximal and distal ends, each of said projections extending axially from said proximal end which is connected to said stem; and a handle for receiving said head, said handle defining a female connection configured to receive and couple with said male connection;

wherein said female connection comprises a pair of longitudinal projections opposite one another in spaced relationship, said projections including an aperture for receiving a hinge pin, said male connection comprising a tongue having an aperture configured to cooperate with said apertures of said longitudinal projections and thereby be capable of receiving the hinge pin to attach said head to said handle.

4. The dental rake of claim 3 wherein said head is formed as a single piece having said concave or convex face.

* * * * *